United States Patent [19]

Thompson

[11] Patent Number: 5,031,415

[45] Date of Patent: Jul. 16, 1991

[54] TWO STAGE COOLING TOWER

[75] Inventor: Tommy L. Thompson, Tucson, Ariz.

[73] Assignee: Planetary Design Corporation, Tucson, Ariz.

[21] Appl. No.: 505,767

[22] Filed: Apr. 6, 1990

[51] Int. Cl.[5] ..... F28D 5/00

[52] U.S. Cl. ..... 62/311; 62/305

[58] Field of Search ..... 62/304, 305, 309, 311; 261/109, 153, DIG. 11; 98/119

[56] References Cited

U.S. PATENT DOCUMENTS 3,116,612 1/1964 Pennington ..... 62/311

4,532,777 8/1985 Thompson ..... 62/434

4,827,733 5/1989 Dinh ..... 62/305

4,926,657 5/1990 Bomar ..... 62/311

*Primary Examiner*—Albert J. Makay

*Assistant Examiner*—John Sollecito

*Attorney, Agent, or Firm*—Mark E. Ogram

[57] ABSTRACT

A tower, or vertical shaft, equipped with a two stage evaporative cooler near the top. The chimney effect, in reverse, causes the cool air to flow by gravity down the tower. The air can be used for cooling and ventilating structures. In one embodiment of the invention, the ambient air flow is all that is required for the embodiment to operate and all reliance upon electrical energy is eliminated.

23 Claims, 3 Drawing Sheets

TWO STAGE COOLING TOWER

BACKGROUND OF THE INVENTION

This invention relates to evaporative cooling systems and more particularly to cool towers.

Natural draft evaporative coolers, popularly known as "cool towers", are recent developments which provide very low cost cooling in dry climates. These towers are used for cooling residences, wind sheltered outdoor areas, and even bus stops, and are found in the southwestern United States and Saudi Arabia.

Operation of the towers depends on the density difference between the tower and outside air. Evaporative cooling pads located around the upper tower perimeter fill the tower with cool air at a higher density than ambient air. The cooler air falls through the tower at a rate which depends on the magnitude of the density difference, the height of the tower, the resistance to air flow provided by the tower and the associated structure, and wind forces on the tower-structure envelope.

As the humidity of the outside air increases, performance of the tower decreases. Because of this, the range of cool towers is extremely limited, usually to areas having particularly dry environs.

In traditional evaporative coolers, a group of developments have arisen which attempt to widen the range of evaporative coolers into more humid environs. These include two-stage cooling systems.

A number of two stage evaporative cooling systems have been developed and are described in depth by *Evaporative Air Conditioning Handbook*, 2nd Ed, Chapmann & Hall, New York, incorporated herein by reference.

All require a first stage heat exchanger which cools outside air without humidification. The pre-cooled air, with a reduced wet bulb temperature, is further cooled by evaporation of water in the second stage evaporative cooler. Heat is also rejected from the first stage heat exchanger by evaporation, either in an external cooling tower or using an additional evaporative cooler, depending on the type of heat exchanger used.

In U.S. Pat. No. 4,532,777, entitled "Two Stage Cooling System" issued to Thompson on Aug. 6, 1985, a two stage cooler is described which utilizes two evaporative steps wherein an oil-like material is cooled by contact with evaporating water. The cooled oil-like material is used to pre-cool, without humidifying, air before a second evaporative cooling step. This patent is incorporated hereinto by reference.

Unfortunately, in many applications, a ready source of electricity does not exist to power the re-circulating pumps, the blowers, and other equipment necessary for two stage coolers to operate.

It is clear from the foregoing that an energy efficient cooling mechanism does not exist that can operate in humid environments.

SUMMARY OF THE INVENTION

This invention consists of a tower, or vertical shaft, equipped with a two stage evaporative cooler near the top. The chimney effect, in reverse, causes the cool air to flow by gravity down the tower. The air is used for cooling and ventilating structures. In one embodiment of the invention, the ambient air flow and hydraulic pressure are all that is required for the embodiment to operate and all reliance upon electrical energy is eliminated.

Even where some electrical power is used to re-circulate water over evaporative pads, electric power consumption is much less than is required for conventional mechanical air conditioning or evaporative cooling, and no fan or blower is required for air movement. This invention achieves lower air temperatures than previous natural draft evaporative coolers operating under the same conditions.

The need for electric power is reduced significantly by using a surging valve such as those commercially available from Energy Saver Mfg. and known as an "Aqua Saver". This type of valve eliminates the need for a re-circulating pump since it "gushes" or pulses the required amount of water over the evaporative pads. A certain amount of water is permitted to go to waste so that scaling does not occur.

Total independence from electrical requirements is obtained by using the invention's timed pulsed water valve which relies upon hydraulic pressure in the timing of the pulses.

A float valve or ballcock in a small tank or reservoir with a variable orifice outlet is used. The float valve controls water flow to the pad distribution system and to the tank containing the float. As the orifice permits the tank to drain, the float valve reaches a point where the float valve opens the line which both charges the evaporative cooling pads and refills the tank with water. Once the tank is filled, the float valve closes the line to the pads and the cycle repeats.

The rate of flow into the tank controls the length of time water flows over the pads. The rate of flow through the outlet orifice controls the time the flow is turned off. Both critical timing considerations are controlled.

Excess water from the pads is collected in small pans under the pads, and discharged by gravity either to waste or used for plant irrigation.

In one embodiment of the invention, the float and tank are placed under the pads and the line refilling the tank is eliminated. The tank is refilled with the water flow from the pads. This thereby controls the time water flows over the pads.

With this device, the hydraulic pressure in the water line supplying the pads provides the timing measurement. Rather than re-circulating water over the pads, a device is used to periodically surge water over the pads. The surges are timed so that the pads never dry completely and enough water is allowed to run to waste so that scaling or mineral deposition does not take place.

The invention, together with various embodiments thereof will be more fully described by the following drawings and their accompanying descriptions.

DRAWINGS IN BRIEF

FIG. 1*a* is a cutaway functional view of an embodiment of the invention that operates without electrical power.

FIG. 1*b* is a end view of the heat exchange tubes of FIG. 1*a*.

DRAWING IN DETAIL

Figure 1A:
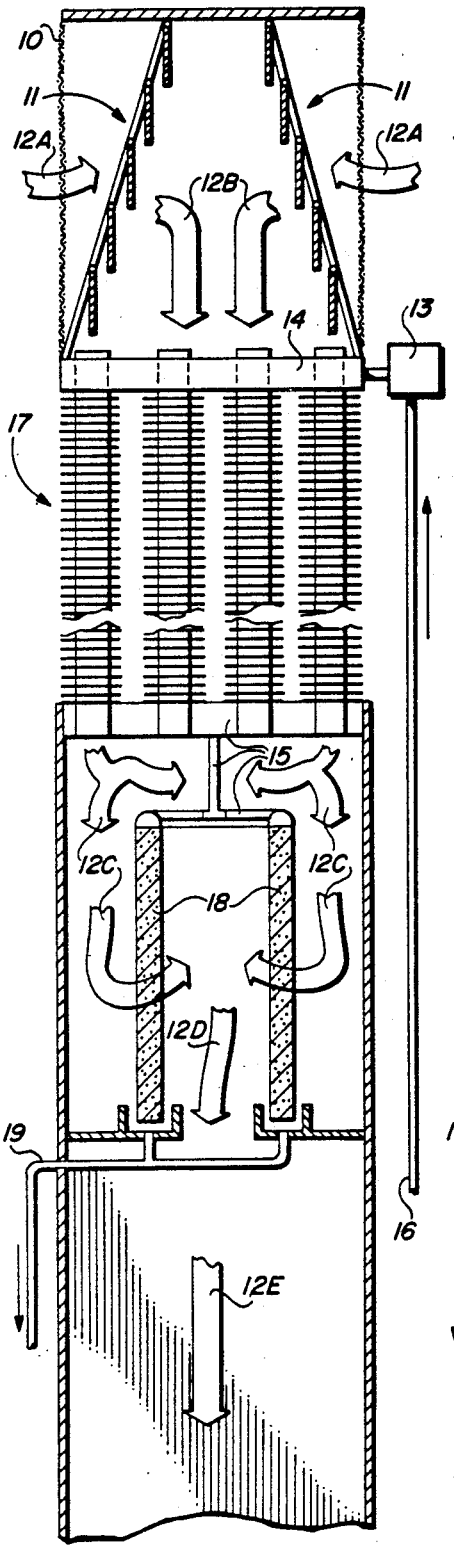

FIG. 1 is a cutaway view of the preferred embodiment of the invention that operates without electrical power.

The tower consists of three parts: a wind catching turret 10; a heat exchanger with extended surfaces on both sides of the tubes 17; and an evaporative cooler section 18.

Turret 10 has insect screen on four sides and a rain tight roof. Gravity dampers 11 are mounted on inclined frames inside turret 10. In the absence of wind, gravity dampers 11 are open; the presence of wind causes the winward dampers to open and the leeward dampers to close, directing air into the heat exchanger tubes 17, as indicated by arrows 12B.

Water from water source 16 is selectively deposited over heat exchanger 17 by flow control 13. (FIG. 1*b* gives a cross section view of the heat exchangers). Flow control 13 modulates the water so that heat exchangers 17 stay moistened and therefore are cooled by evaporative cooling.

The exterior of the tubes constituting heat exchanger 17 are cooled by wind-driven evaporation.

Excess water from heat exchangers 17 is collected and redistributed 15 by a pan at the base of the tubes and piping over evaporative cooler pads 18. In this manner, water is deposited, in a serial manner, first on the heat exchanger 17 and then on evaporative pads 18.

Air flows from the turret, as indicated by arrows 12A and 12B, through the interior of heat exchanger tubes 17, to cooler pads 18. The air is further cooled and humidified by cooler pads 18 as the air falls through tower 18, and finally into the structure (as indicated by arrow 12E) to be air conditioned.

In this manner, the air to be cooled is pre-cooled by heat exchanger 17 without raising the moisture content of the air. A second cooling step is performed by cooler pads 18 providing a greatly enhanced cooling system.

FIG. 1*b* is a cross sectional view of the heat exchange tube of FIG. 1.

The heat exchanger tubes have longitudinal internal fins 8 with circumferential fins 9 outside. The outside fins 9 are preferrably coated with a wettable material, such as floc, to retain water. The heat exchanger also operates with plain tubes, without fins or extended surfaces.

Drain slots 7 permit water to pass from one circumferntial fin to another in an organized manner.

The inside tube area should be about four times the outside area as the outside heat transfer coefficients are larger than those for the dry inside surface where the primary air flow exists.

Figure 1B:
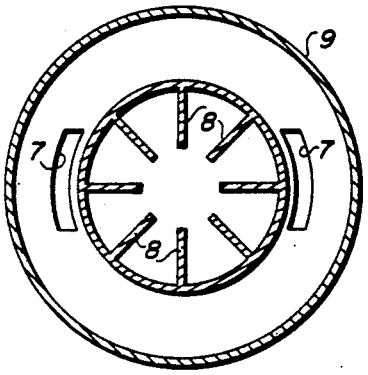

Water is distributed over the outside of the finned tubes as discussed in FIG. 1A. A portion of the water evaporates, cooling the air inside the tubes without humidifying it.

The heat exchanger tubes permit one surface (the exterior in this case) to be cooled through evaporation and let the primary air (that which is used to cool the building) to be cooled by a second surface (the interior and fins 8 in this example) without raising the moisture content of the primary air stream.

Figure 2:
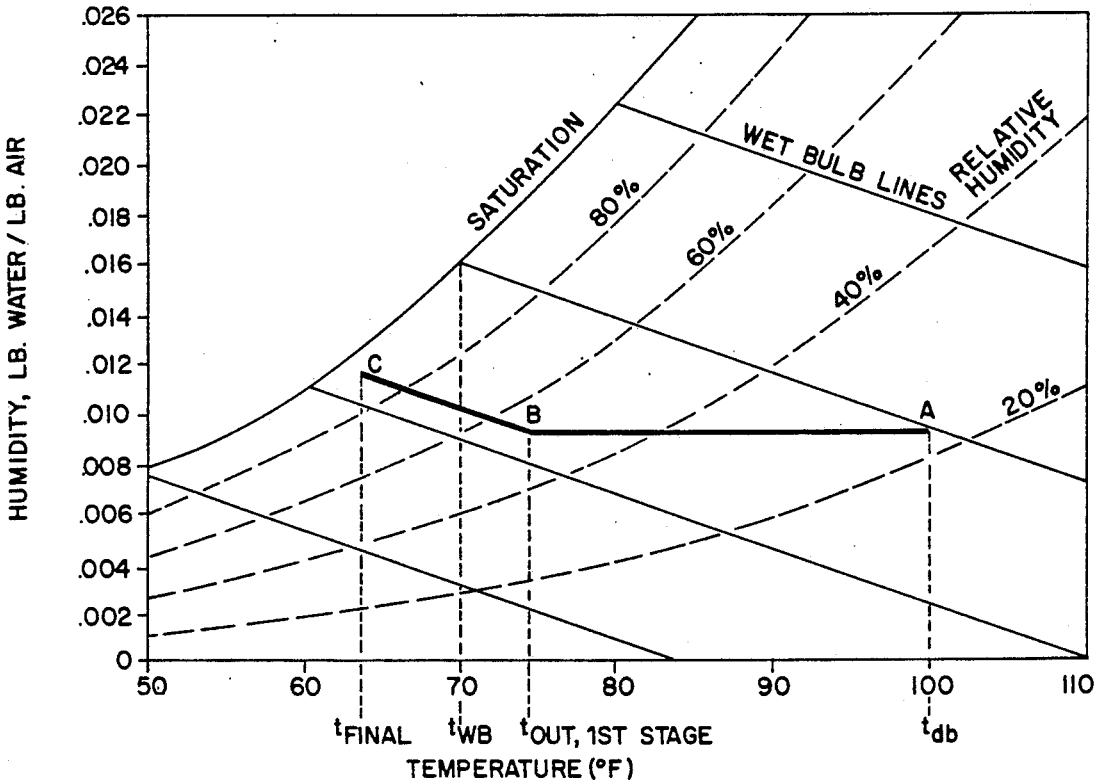
FIG. 2 is psychrometric chart illustrating the cooling capability of the present invention.

The process is further illustrated on the psychometric chart of FIG. 2.

Outside air at point A, 100 degrees F. dry bulb and 70 degrees F. wet bulb in this example, is cooled without humidification to point B in the heat exchanger. Air is cooled by the evaporative cooler pads to point C, or roughly 63 degrees F.

A single stage cooler tower of the prior art can produce air at approximately 75 degrees F. The air flow through the tower is proportional to the square root of the difference between the outside and tower temperatures, in the windless case. Hence, the driving force for air flow would be about 20% greater for the two stage tower.

Figure 3:
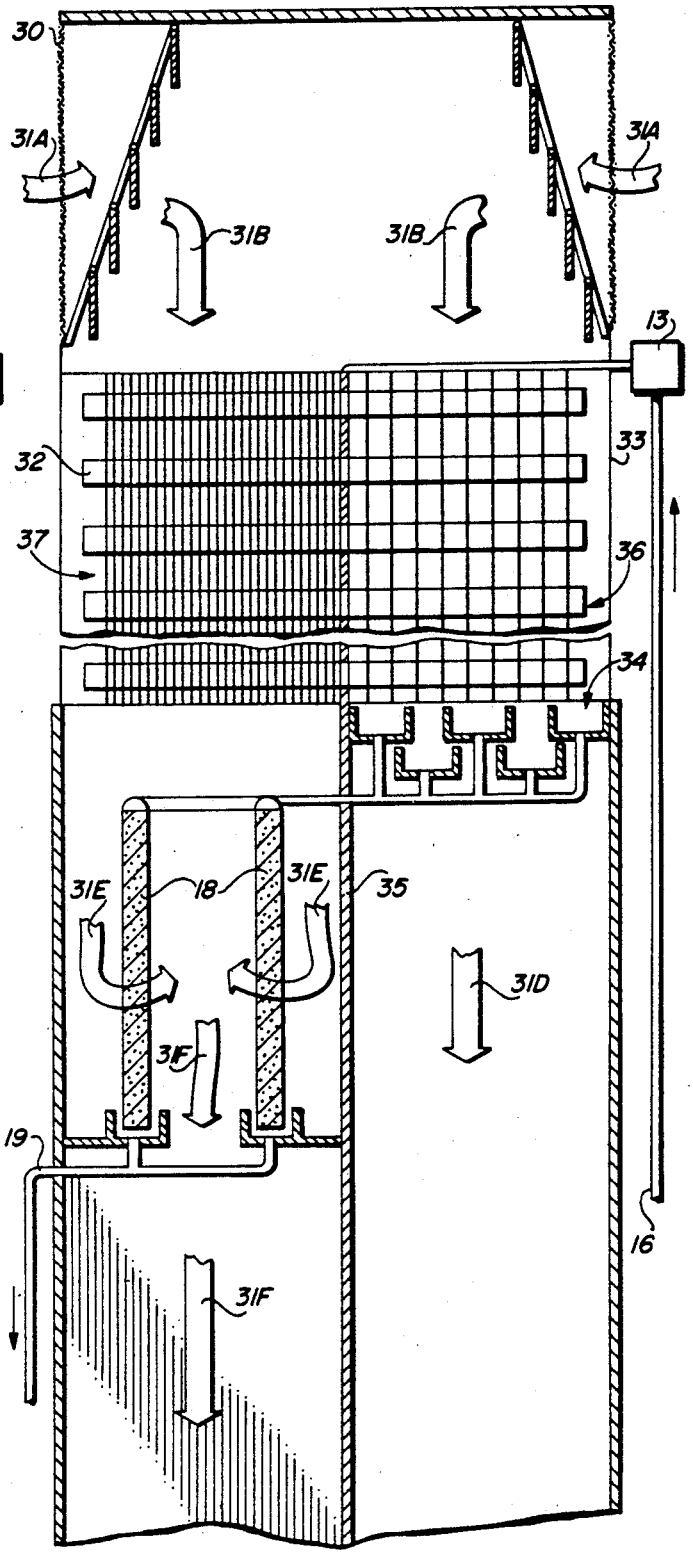
FIG. 3 is a cutaway functional view of another embodiment of the invention.

FIG. 3 is a cutaway functional view of another embodiment of the invention.

In this embodiment, the heat exchanger 32 is a heat pipe assembly. Heat pipes are characterized by a very low longitudinal resistance to heat flow, and a wide variety of designs are commercially available. Those of ordinary skill in the art readily recognize various devices that work in this capacity.

The finned heat exchanger heat pipes 32 pass through a partition 35, dividing the exchanger into a wet section 36 and a dry section 37. The area ratio of the dry section 37 to wet section 36 is ideally about four to one with the wet side fins treated for wettability. That is, a floc or other water retaining material is preferrably placed around the heat exchange pipes 36. The pipes are wetted by flow control 13 which is any of the common valves or surging valves known to those of ordinary skill in the art.

Tower 30 is similarly divided vertically into two sections by partition 35: a dry section leading to the evaporative cooler pads 18 and the cooled structure 31F; and a parallel section discharging to waste 31D.

Air flows into the turret as described for FIG. 1 is split into two streams. One stream 31C flows over the wetted finned heat pipes 36 and which are reduced in temperature by evaporative cooling while heat is removed from the dry cooling section.

In another embodiment careful design is required to assure that the temperature drop through heat exchanger 36 is sufficient to operate as an auxiliary cool tower. "Waste" air stream 31D is usually cool enough to ventilate basements, garages, or other areas where great comfort is not required.

Dry section 31B operates as described for FIG. 1, with a reduction in temperatures as air flows through the dry section of the heat exchanger 37 and final cooling in the evaporative cooler.

As indicated by arrow 31E, air from heat exchanger 37 flows over the evaporative cooling pads 18 and generates cooled air flow 31F.

Figure 4:
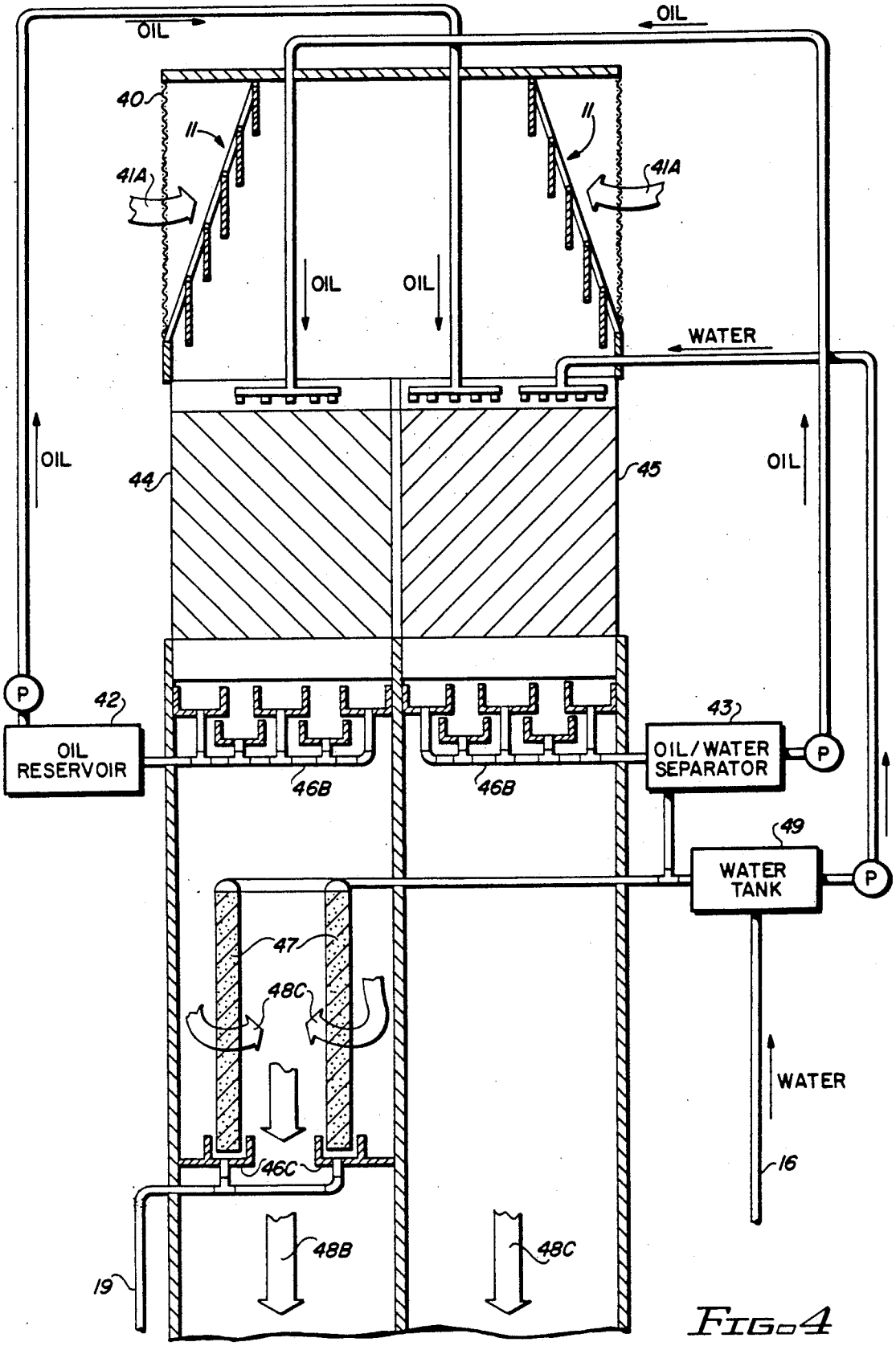
FIG. 4 is a cutaway functional view of still another embodiment of the invention.

FIG. 4 also employs the split tower concept, with the oil-water system of U.S. Pat. No. 4,532,777.

In this example packed towers are used, which could be packed with Raschig rings, Pall Rings, or a suitable cooling tower fill, well known to those of ordinary skill in the art.

Water and oil are pumped over packing in the heat rejecting section 45. Utilizing air flow 41A, heat is transferred from the oil to the water, which evaporates into the waste air stream 48C. At the base of packing 45, the water-oil mixture is collected by pans 46A and separated in chamber 43.

Oil from the separator is pumped to the water free packed tower 44 which removes sensible heat from the primary air stream.

The cooled oil in packed tower 44 absorbs heat from the primary air flow. This exchange of heat from air to oil at packed tower 44 does not raise the moisture level of the air permitting evaporative pads 47 to effectively cool air flow 48A generating cool air flow 48B.

Warmed oil is caught in pans 46B from packed tower 44 and is re-circulated to packed tower 45 to repeat the cycle.

Evaporative pads 47 utilize water from the oil/water separator 43. Excess water from evaporative pads 47 is collected in pans 46C and discharged as waste 19.

Figure 5:
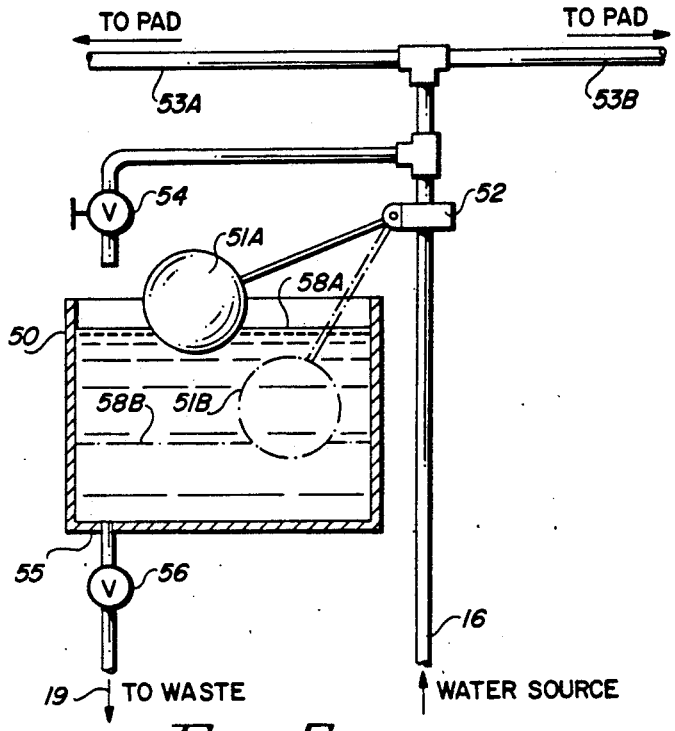
FIG. 5 is a cutaway functional view of a valve which utilizes hydraulic pressure from the water source for timing control.

FIG. 5 is a cutaway view of a valve which utilizes hydraulic pressure from the water source as its timing device.

A common float 51A and float valve 52 are used in a small tank 50 having a outlet orifice 55. The flow of water from tank 50 through outlet orifice 55 is controlled via valve 56. Water through valve 56 is discharged as waste 19.

Float valve 52 is used to control the flow of water over the evaporative cooler pads 53A and 53B (not shown) which are described in FIGS. 1A, 3, and 4. Float valve 52 also controls water flow to tank 50 containing float 51A.

Beginning the description with the valve closed and the float 51A at its highest position as controlled by water level 58A in tank 50, valve 56 is adjusted for the water to drain slowly from tank 50. The rate at which the water drains and the volume of the tank largely controls the cycle duration of the assembly.

When the water level drops to 58B, a point determined by the float valve assembly (51A and 52) and installation, valve 52 opens, allowing water from water source 16 to: (i) flow to the pads 53A and 53B through the main line; and, (ii) a much smaller amount of water to flow through a second line, through adjustable valve 54 and into tank 50, thereby raising the water level eventually to level 58A.

When tank 50 fills, float valve 52, responding to float 51A, stops flow to the pads and into tank 50, and the operating cycle is completed. The tanks continues to drain and the cycle naturally repeats.

Note that the rate of flow through adjustable valve 54 into tank 50 controls the length of time water flows over the pads. The rate of flow through the variable orifice 55 and valve 56 controls the time the water flow is turned off.

It is clear from the foregoing that the present invention creates an energy efficient cooling mechanism that is capable of operating in environments that heretofore were too humid.

What is claimed is:

1. A cooling tower comprising:

a) a tower having,
   1) at least one wind opening for admission of an ambient air flow caused by naturally occurring wind or downdraft,
   2) at least one exhaust window at the bottom, and
   3) damper means for preventing said ambient air flow from exiting through said at least one wind opening;

b) a water supply;

c) a heat exchanger;

d) a primary cooling system having means for evaporatively cooling a first surface of said heat exchanger using water from said water supply and a first portion of said ambient air flow;

e) a first cooling means for cooling a second portion of said ambient air flow through contact with a second surface of said heat exchanger; and, f) a second cooling means for,
   1) evaporatively cooling said second portion of said ambient air flow from said first cooling means, and,
   2) exhausting said second portion of said ambient air flow through said at least one exhaust window.

2. The cooling tower according to claim 1 further including means for trapping excess water from said primary cooling system and for directing said excess water to said second cooling means.

3. The cooling tower according to claim 1 wherein said primary cooling system includes evaporative pads in contact with said heat exchanger.

4. The cooling tower according to claim 3 wherein said heat exchanger includes heat pipes.

5. The cooling tower according to claim 3 wherein said heat exchanger includes at least two pipes for conduction of said second portion of said ambient air flow.

6. The cooling tower according to claim 5 wherein said at least two pipes further include heat exchange fins on the interior thereof.

7. The cooling tower according to claim 6 wherein said at least one wind opening on said tower is substantially at the top of said tower.

8. A mechanism for cooling ambient air comprising:

a) a tower having,
   1) an airflow path,
   2) at least one wind opening for admission of an ambient air flow caused by naturally occurring wind or downdraft to said airflow chamber,
   3) damper means for preventing said ambient air flow from exiting through said at least one wind opening, and,
   4) at least one exhaust window for exhausting air from said airflow chamber;

b) a water supply line supplying pressurized water to said tower;

c) a heat exchanger having a first surface and a second surface;

d) a primary cooling system having means for evaporatively cooling the first surface of said heat exchanger using water from said water supply line and a first portion of said ambient air flow;

e) a first cooling means for cooling a second portion of said ambient air flow through contact with the second surface of said heat exchanger;

f) means for capturing excess water from said primary cooling system; and, g) a second cooling means for,
   1) evaporatively cooling said second portion of said ambient air flow using water from said means for capturing excess water, and,
   2) exhausting said second portion of said ambient air flow through said at least one exhaust window.

9. The mechanism according to claim 8 wherein said primary cooling system includes evaporative pads in contact with said heat exchanger.

10. The mechanism according to claim 9 wherein said heat exchanger includes heat pipes.

11. The mechanism according to claim 9 wherein said heat exchanger includes at least two pipes for conduction of said second portion of said ambient air flow.

12. The mechanism according to claim 11 further including means for exhausting said first portion of ambient air.

13. The mechanism according to claim 12 wherein said at least two pipes further include heat exchange fins on the interior thereof.

14. The mechanism according to claim 9 wherein said at least one wind opening on said tower is substantially at the top of said tower.

15. An energy efficient cooling mechanism comprising:

a) a tower having,
   1) a first airflow path,
   2) a second airflow path,
   3) at least one wind opening for admission of an ambient air flow caused by naturally occurring wind or downdraft to said first airflow path,
   4) gravity damper means for preventing said ambient air flow from exiting through said at least one wind opening;
   5) means for directing a first portion of an ambient air flow through said first airflow path,
   6) at least one exhaust window for exhausting air from said first airflow path,
   7) means for directing a second portion of the ambient air flow through said second airflow path, and,
   8) at least one exhaust window for exhausting air from said second airflow path;

b) a water supply line supplying pressurized water to said tower;

c) a heat exchanger having a first surface and a second surface, said first surface communicating with said first airflow path, said second surface communicating with said second airflow path;

d) a primary cooling system having means for evaporatively cooling the first surface of said heat exchanger using water from said water supply line and the first portion of said ambient air flow;

e) a first cooling means for cooling the second portion of said ambient air flow through contact with the second surface of said heat exchanger;

f) means for capturing excess water from said primary cooling system; and, g) a second cooling means for,
   1) evaporatively cooling said second portion of said ambient air flow in said second air flow path using water from said means for capturing excess water, and,
   2) exhausting said second portion of said ambient air.

16. The mechanism according to claim 15 wherein said primary cooling system includes evaporative pads in contact with said heat exchanger.

17. The mechanism according to claim 16 wherein said heat exchanger includes heat pipes.

18. The mechanism according to claim 16 wherein said heat exchanger includes at least two pipes for conduction of said second portion of said ambient air flow.

19. The mechanism according to claim 18 further including means for exhausting said first portion of ambient air.

20. The mechanism according to claim 19 wherein said at least two pipes further include heat exchange fins on the interior thereof.

21. The mechanism according to claim 16 wherein said at least one wind opening on said tower is substantially at the top of said tower.

22. A method of cooling an air flow of ambient air comprising the steps of:

a) admitting said air flow of ambient air into a top portion of a tower;

b) preventing said ambient air flow from exiting through said top portion of a tower;

b) evaporatively cooling a first surface of a heat exchanger using water from a water supply and a first portion of said ambient air flow;

c) cooling a second portion of said ambient air flow through contact with a second surface of said heat exchanger;

d) evaporatively cooling said second portion of said embient air flow; and, e) exhausting said second portion of said ambient air flow through at least one exhaust window located at a bottom portion of said tower.

23. The method of cooling an air flow according to claim 22 further comprising the steps of:

a) trapping excess water from said first surface of said heat exchanger; and, b) directing said excess water to a second cooling means.

* * * * *